US011473368B2

(12) United States Patent
Prodromou

(10) Patent No.: US 11,473,368 B2
(45) Date of Patent: Oct. 18, 2022

(54) PROTECTIVE COVER DEVICE AND METHOD TO MANUFACTURE SAID COVER DEVICE

(71) Applicant: Phrixos Prodromou, Ruislip (GB)

(72) Inventor: Phrixos Prodromou, Ruislip (GB)

( * ) Notice: Subject to any disclaimer, the term of this patent is extended or adjusted under 35 U.S.C. 154(b) by 265 days.

(21) Appl. No.: 16/644,479

(22) PCT Filed: Sep. 6, 2018

(86) PCT No.: PCT/GB2018/052523
§ 371 (c)(1),
(2) Date: Mar. 4, 2020

(87) PCT Pub. No.: WO2019/048861
PCT Pub. Date: Mar. 14, 2019

(65) Prior Publication Data

US 2020/0284079 A1 Sep. 10, 2020

(30) Foreign Application Priority Data

Sep. 11, 2017 (GB) ..... 1714561

(51) Int. Cl.
*E06B 7/36* (2006.01)
*E05D 9/00* (2006.01)
*E05D 11/00* (2006.01)

(52) U.S. Cl.
CPC ..... *E06B 7/367* (2013.01); *E05D 9/005* (2013.01); *E05D 11/0054* (2013.01); *E05D 2011/0072* (2013.01)

(58) Field of Classification Search
CPC . E06B 7/36; E06B 7/367; E05D 9/005; E05D 11/0054; E05D 2011/0072; Y10T 16/5335; Y10T 16/533
See application file for complete search history.

(56) References Cited

U.S. PATENT DOCUMENTS 1,444,398 A * 2/1923 Shepherd ..... E06B 7/367 296/63
2,694,234 A * 11/1954 Roby ..... E06B 7/367 16/250

(Continued)

FOREIGN PATENT DOCUMENTS

KR 20050022147 A 3/2005
KR 20140092124 A 7/2014
WO 9215763 A1 9/1992

*Primary Examiner* — Justin B Rephann
(74) *Attorney, Agent, or Firm* — Craft Chu PLLC; Andrew W. Chu

(57) ABSTRACT

A cover device for covering the angle formed between the edge of a hinged door and a door frame includes first and second elongate bodies, each body having substantially parallel sides and divided by hinge lines parallel to the sides into a plurality of elongate panels. The first body is mountable at one end to the door, and the second body is mountable at one end to a frame relative to which the door hinges. The hingeable connection between the bodies is by at least one longitudinal channel and at least one longitudinal protrusion which locates within the channel to be removeably held within it but able to move longitudinally with respect to it, and thereby to act as a hinge whilst enabling the relative longitudinal movement between the elongate bodies.

16 Claims, 13 Drawing Sheets

(56) References Cited

U.S. PATENT DOCUMENTS 2,910,741 A * 11/1959 Dettman ..... E06B 7/367 16/250
5,001,862 A * 3/1991 Albenda ..... E06B 7/367 49/383
5,092,077 A * 3/1992 Teinturier-Milgram ..... E06B 7/367 160/40
5,419,084 A * 5/1995 Sankey ..... E06B 7/367 160/40
6,141,909 A * 11/2000 Hanson ..... E06B 7/367 160/40
6,497,073 B2 * 12/2002 Webb ..... E06B 7/367 160/40
6,643,980 B1 * 11/2003 Dorder ..... E06B 7/367 49/460
6,931,789 B2 * 8/2005 Stout, Jr. ..... E06B 7/367 160/40
7,712,257 B2 * 5/2010 Johnson ..... E06B 7/367 49/383
7,836,635 B2 * 11/2010 Webb ..... E06B 7/367 49/384
9,181,749 B1 * 11/2015 Davis ..... E06B 7/36
2004/0237411 A1 * 12/2004 Shaharbani ..... E06B 7/367 49/383
2005/0060939 A1 * 3/2005 Stout, Jr. ..... E06B 7/367 49/383
2005/0066583 A1 * 3/2005 Newcombe ..... E06B 7/367 49/462
2005/0108946 A1 * 5/2005 Shaharbani ..... E06B 7/367 49/383
2006/0101617 A1 * 5/2006 Webb ..... E06B 7/367 16/250
2010/0088962 A1 * 4/2010 McRoskey ..... E06B 7/36 49/303
2011/0302845 A1 * 12/2011 McRoskey ..... E06B 7/367 49/460
2012/0210648 A1 * 8/2012 Yang ..... E06B 7/367 49/383
2015/0211291 A1 * 7/2015 Jaffee ..... E06B 7/367 16/250

* cited by examiner

PROTECTIVE COVER DEVICE AND METHOD TO MANUFACTURE SAID COVER DEVICE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to a protective cover device. In particular it relates to a protective device of the type known as a hinge guard for covering the angle formed between the edge of a hinged door and a doorframe to form a barrier preventing access to the angle by fingers so as to avoid pinching or similar injuries.

2. Description of Related Art Including Information Disclosed Under 37 CFR 1.97 and 37 CFR 1.98

Covers of this type are known from, for example, GB-A-231078 and GB-A-2505720.

Each of these provide a hinge cover device formed by an elongate strip 1, preferably of length corresponding to the height of door and which is suitably formed as a substantially flat extrusion of polypropylene, PVC or other plastic material. This strip has parallel sides and is divided by parallel hinge lines 2 into a plurality of elongate panels. A first outer one of these is adapted to be fixed to the face of a door adjacent to the door edge and the second remote of these is adapted to be fixed to the doorframe, adjacent to that part of the doorframe which faces the door when the door is fully closed. The panels are separated hinge lines, which may be of reduced thickness compared to the panel and which enables the panels to hinge relative to each other, by acting as a living hinge.

The arrangement is generally that when a door is fully open the cover device forms a generally convex cover over the angle between the door and the frame but as the door closes onto the hinge the panels begin to hinge against each other to form a general polygonal hollow shape with bends in and thereby provides a relatively stiff barrier preventing access to the angle between a door and frame. In the fully closed position of the door of these prior art arrangements, the cover device folds to form a hollow polygonal structure which is substantially rectangular, blends in well with the door and doorframe if it is the same colour, and which prevents fingers being inserted into the frame and therefore possibly damaged as the door opens or closes. At all times the current device forms a barrier to the angle between the door and the frame and this barrier can form various polygonal shapes according to the opening state of the door.

GB-A-2505720 introduces further panels which can concertina to abut against each other and which enables such a device to be used on a larger door and door opening angle than that of GB-A-2321078.

However, there are still some doors which cannot be protected, in particular thick doors or very wide opening doors as might be used in public buildings such as hospitals and so on. In addition, the previously proposed devices are problematic when used with doors with rising butt hinges, in which the door rises as it is opened in order to provide clearance over a carpet, for example. As the device is fixed both to a door and doorframe, the device is unable to cope with the door rising relative to the frame as it is opened without tending to pull the cover device off the surface of the door or frame to which it is attached.

BRIEF SUMMARY OF THE INVENTION

The present invention arose in attempt to provide an improved protective cover device.

In a first aspect the invention provides a cover device for covering the angle formed between the edge of a hinged door and a doorframe, comprising first and second elongate bodies, each body having substantially parallel sides and divided by hinge lines parallel to the sides into a plurality of elongate panels, wherein at least some of the panels are hingable relative to an adjacent panel in order to enable at least some of the panels to concertina relative to each other, the first body being mountable at one end to the door and the second body being mountable at one end to a frame relative to which the door hinges, and the respective free ends of the first and second bodies being removeably hingably connected together and which enables a degree of relative movement of one body, in a direction parallel to the hinge lines, relative to the other body.

Preferably, the first body includes a channel and the second body includes a protrusion which fits into the channel (typically from the top or bottom and which slide into position with respect to the first body) such that the protrusion enables a relative angular motion whilst enabling the second body to have a degree of free (i.e. generally vertically) movement in a direction parallel to the hinge lines relative to the first body. Thus, if the door has rising butt hinges, as the door is closed, the body attached to that door can rise slightly relative to the body attached to the frame to thereby accommodate the rising of the door without stressing the connection.

In a further embodiment, each of the bodies includes a channel and a third member having two protrusions is provided, one of which fits in the first body's channel and the other which fits within the second body's channel, the third body connecting and enabling relative hinging and longitudinal movement between the first and second body.

Alternatively the third (connection member) may have the channels and the bodies and the protrusions, or the connection member may have one channel and one protrusion, one body having a channel and the other having a protrusion.

The first and/or second body may be formed of two different plastics, one having more rigidity than the other. They may be formed by a co-extrusion process.

The invention further provides a door and frame protected by a cover device as above.

BRIEF DESCRIPTION OF THE SEVERAL VIEWS OF THE DRAWINGS

Embodiments of the invention will now be described, by way of example only, with reference to the accompanying drawings.

DETAILED DESCRIPTION OF THE INVENTION

Figure 1:
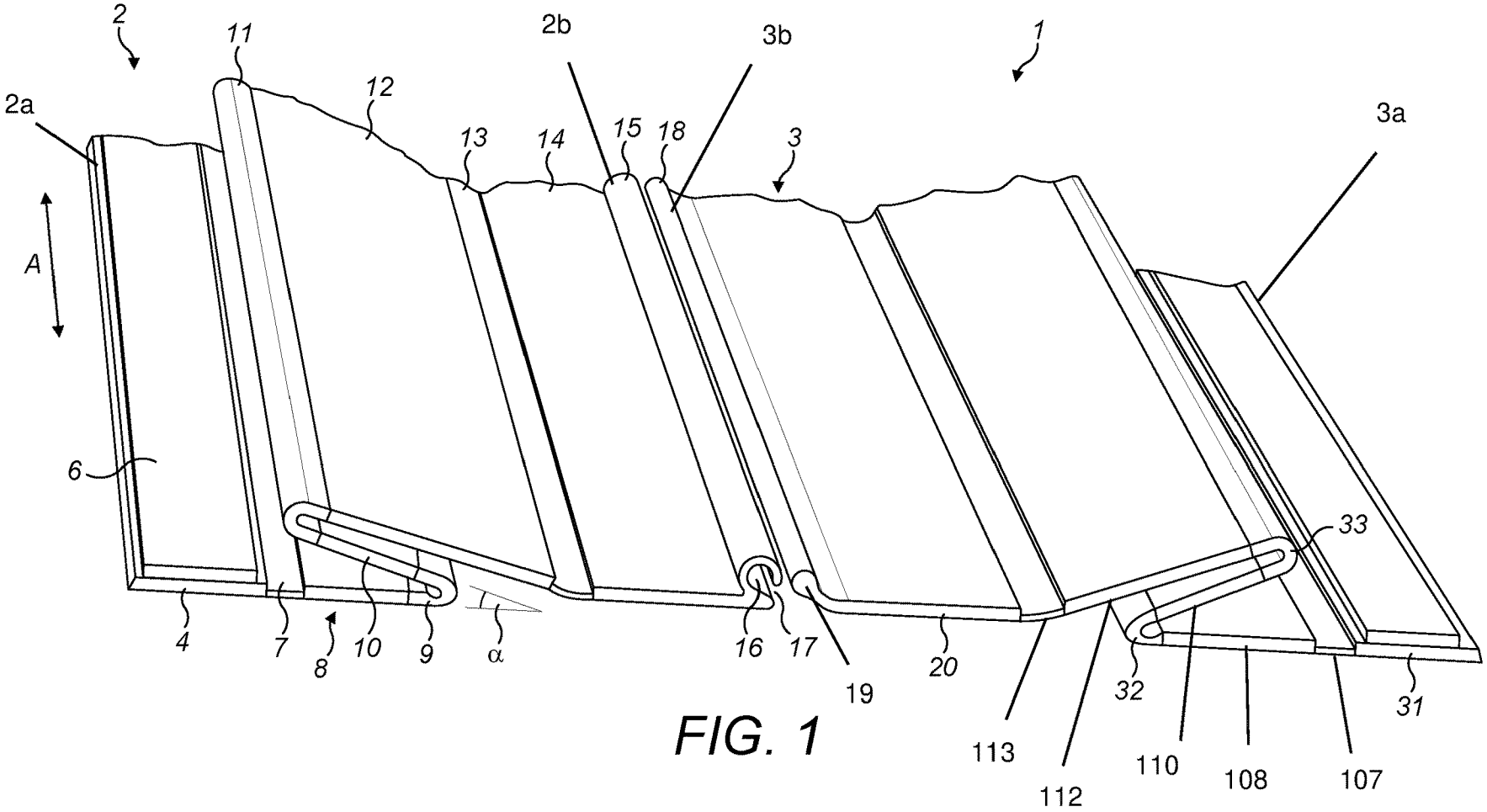
FIG. 1 shows the cover device formed of two bodies.

Referring to the drawings, FIGS. 1 to 5 show a first embodiment. A cover device 1 comprises two similar but (in this embodiment) not identical bodies 2 and 3 (first elongate body 2 having a first proximal side 2*a* and a first distal side 2*b*, second elongate body 3 having a second proximal side 3*a*, a second distal side 3*b*). Each of the bodies is an elongate strip which is preferably of length (in direction A) of approximately the height of a door to which it is to be affixed. Alternatively, it may be of reduced height. The bodies will be placed in a position on the door and frame where a child's (or adult's) fingers are likely to be impinged upon if the child uses their fingers between door and frame. The strips are formed of plastic material such as polypropylene, PVC or other material and includes two different types of plastic, one of which is more rigid than the other. They may be co-extruded to form single articles comprising two materials. The rigid parts comprise generally flat panel portions whilst the less rigid parts, which may be flat or curved, form hinge parts (living hinges) in the finished strip. The parts are identical apart from their innermost edge.

Body one (first elongate body 2) will now be described in detail.

Figure 2:
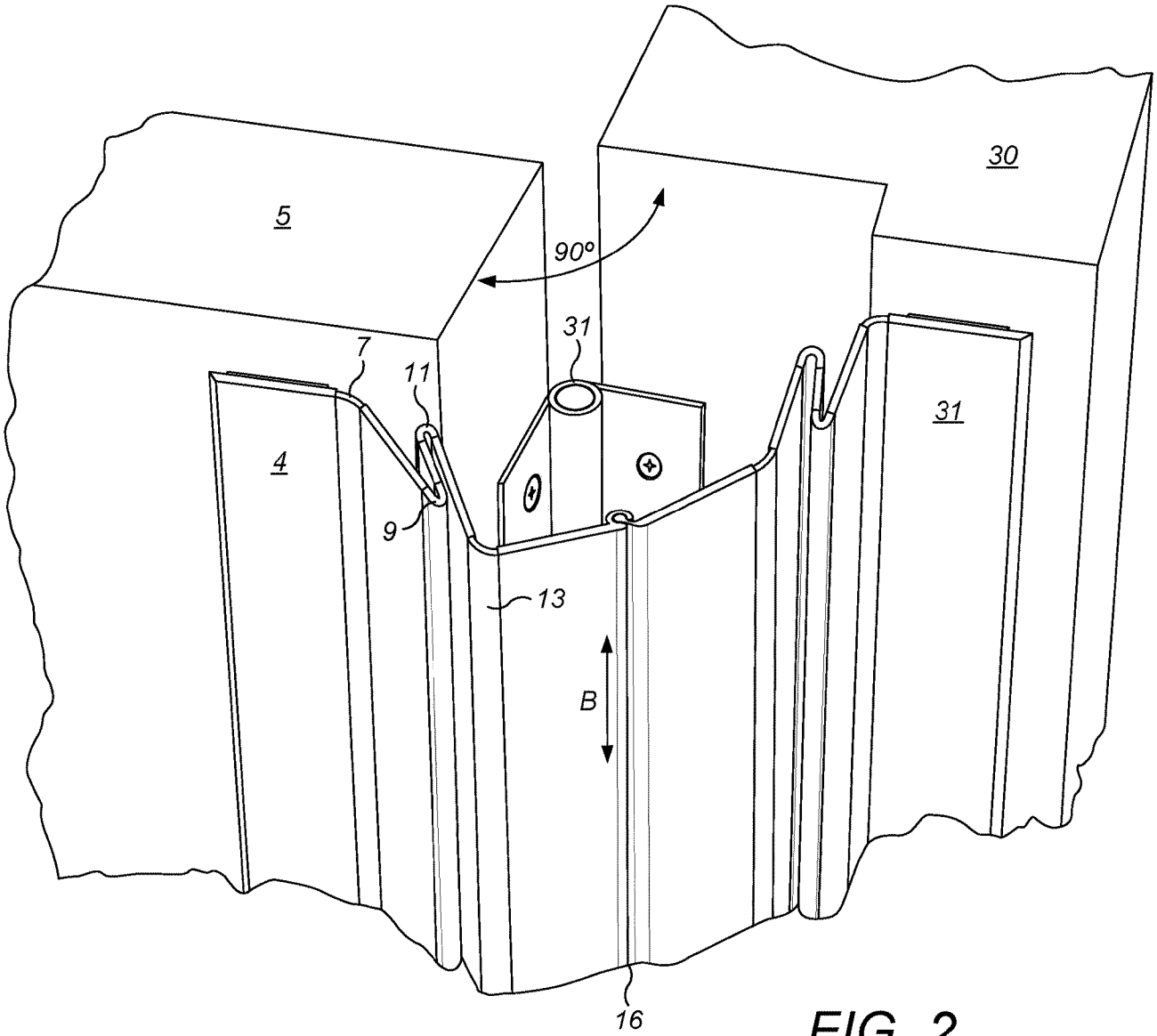
FIG. 2 shows the cover device in position between a door and frame with the door partially opened.

This comprises a first outer panel 4 adapted to be fixed to a face of door 5 (FIG. 2). A layer of double-sided tape 6 is fixed to one face of panel 4 affixing this to the door 5. However, other methods of attaching the panel to the door may be used, such as screws, brackets and so on.

Adjacent to panel 4 (first outer panel 4, second outer panel 31 for the second elongate body 3) is a strip of more flexible plastic 7 (first outer panel flexible hinge portion 7, second outer panel flexible hinge portion 107 for the second elongate body 3) and this may, as shown, be of reduced depth compared to the depth of panel 4. This can therefore act as a hinge.

The next panel is another rigid panel 8 (first penultimate proximal panel 8, second penultimate proximal panel 108 for the second elongate body 3). Note that in general the rigid panels are of greater width (the dimension of the panel in a direction perpendicular to the hinge lines) than the less rigid ones, but this is not necessarily so in all embodiments.

The next part is a hinge portion 9 (first penultimate proximal hinge portion 9, second penultimate proximal hinge portion 32 for the second elongate body 3) which is preferably, together with the other hinge portions, formed of a less rigid, flexible, plastic material (although it may all be formed of the same plastic material in some embodiments with flexibility being obtained by reduced depth portions or otherwise).

The next portion 10 (first middle panel 10, second middle panel 110 for the second elongate body 3) is another rigid planar portion and the other end of this connects to a further hinge 11 (first middle hinge portion 11, second middle hinge portion 33 the second elongate body 3). A further rigid planar panel 12 (first penultimate distal panel 12, second penultimate distal panel 112 for the second elongate body 3) extends from hinge 11, followed by a hinge 13 (first penultimate distal hinge portion 13, second penultimate distal hinge portion 113 for the second elongate body 3).

FIG. 1 shows how the strips may be manufactured (typically by extrusion) such that hinge parts 9 and 11 are already bent (i.e. pre-formed in their bent disposition) to subtend an angle of between their ends of less than 90° (the angle Figure of 1). Thus, the strip is formed with a "memory profile" of these angles, but the hinges can open out to "extend" the strip, or closed to "shorten" the strip, and will then return to the initial "memory" position. The hinges can allow movement between substantially 180° (i.e. where the adjacent rigid panel such as panels 8 and 9 are in line with each other) to substantially 60°. Where the panels 8, 10 and 12 lie substantially flat upon each other such a panel 10 lies flat upon panel 8 (or closed to shorten the strip).

By "extend" or "shorten" is meant to increase or decrease the distance in space between the ends (i.e. straighten out or increase the bends in the body), so that when in situ a door can be opened to increase the distance between a part of it and the frame, or closed to reduce the distance.

Hinge 13 is a hinge similar to that of hinge 7. A further planar panel 14 (first inner panel 14, second inner panel 20 for the second elongate body 3) leads to the distal (free) end 15 which is formed to include (at least part of its length) a channel 16 (a first inner panel hinge connector 16, 17, 19, a second inner panel hinge connector 16, 17, 19 for the second elongate body 3). This is achieved by part 15 having a part cylindrical or at least concavely arcuate form, forming a channel within having an opening 17. The opening preferably faces in a direction generally away from panel 4 (when the article is manufactured) but may otherwise disposed, and in the embodiment shown is at an angle.

Part 3 is similar to part 1 apart from the distal edge 18 (second distal side 3*b*). Instead of having a channel formed in it, this forms a bulbous protrusion 19 intended to locate within channel 16. As shown, this may be of width (at its widest point) greater than the width of at least part of the rigid section 20 which is adjacent to it, and the opening 17 of the channel is less than the width of the protrusion 19 such that when the protrusion is in place it cannot simply be pulled out easily.

The protrusion can be otherwise shaped. Preferably it has a part-circular cylindrical cross-section with a waist portion 19*a* narrower that the nearest part of the protrusion and panel 20 (as in FIG. 5) and the channel has a corresponding cylindrical internal cross-section so that the two can relatively rotate.

The remainder of body strip 3 (second elongate body 3) is identical to that of body strip 2 (first elongate body 2).

The two parts may therefore be joined by sliding one part into the other from the top or bottom, such that the protrusion 19 locates within channel 16.

Alternatively, by arranging for channel 16 and its opening 17 to have some flexibility such that it can be resiliently deformed to enlarge opening 17, the protrusion can be pushed in by a snap fit. Once, the enlarged protrusion is located the opening will resiliency close, requiring considerable force to pull protrusion 19 out.

When assembled together the two parts may therefore hinge relative to each other about the joint formed between protrusion 19 and channel 16, and also a degree of longitudinal movement is enabled (typically up or down in a vertical direction when the bodies are mounted between the door and frame). The joint between the bodies therefore acts as hinge between panels 14 and 20 (the panel adjacent to protrusion 19) but also enables for relative longitudinal movement. It is this relatively longitudinal movement that can enable one of the strips to move longitudinally relative to the other to accommodate a rising butt hinge on a door for example.

FIG. 2 shows the strips mounted between a door 5 and frame 30. The door is opened around 90° relative to the frame and this is typically the position at which the door is opened in order for the bodies to be mounted on the respective door and frame by virtue of panels 4 and 31, each being affixed to the respective door and frame by double-sided tape, screws or otherwise.

FIG. 2 shows a rising butt hinge 31 and illustrates by arrow B the direction which relative movement can be achieved.

Figure 3:
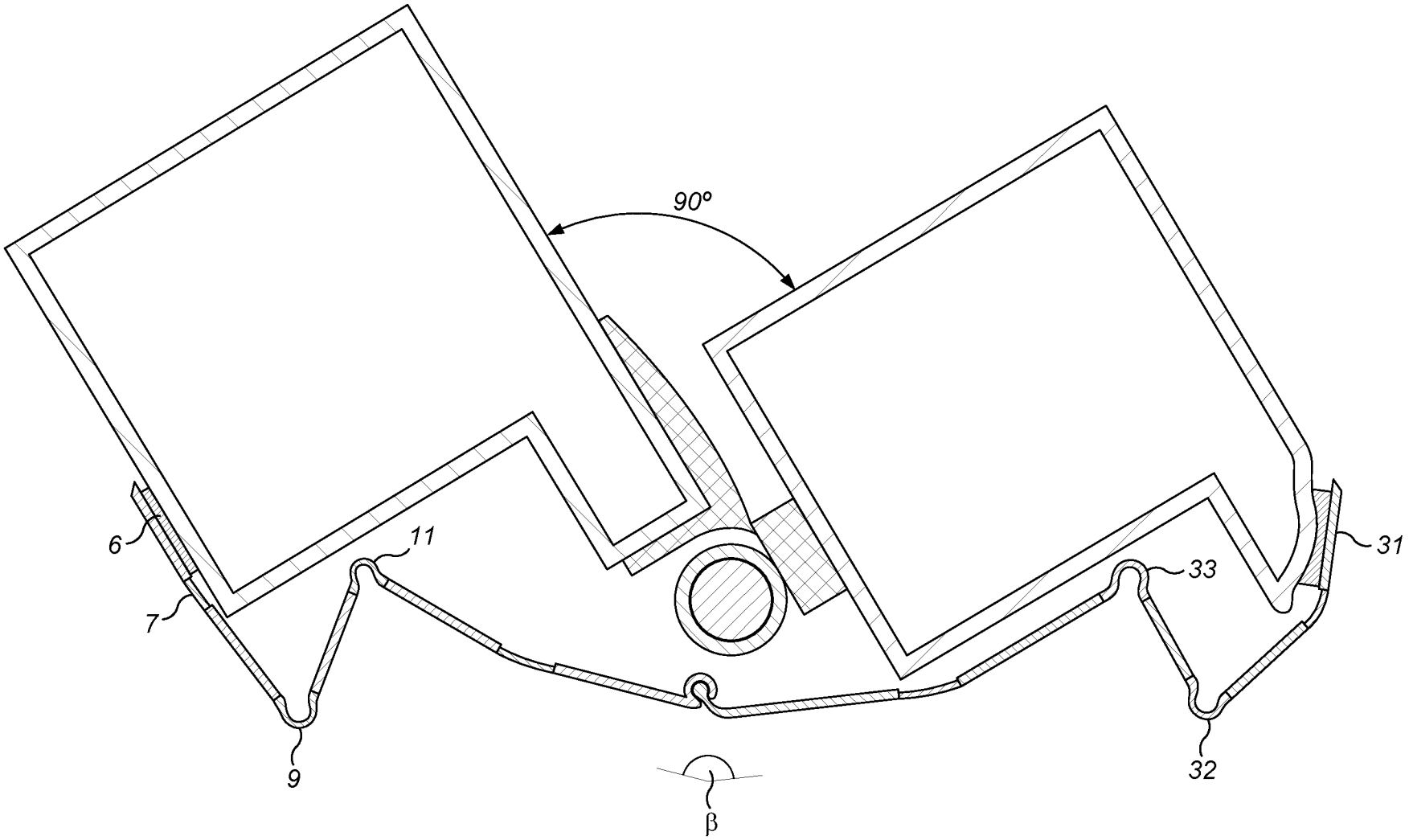
FIG. 3 shows the device with the door open further.

FIG. 3 is a top view and shows how as the door is opened further the two bodies 2 and 3 can open about hinges 9 and 11 of the one part, and 32 and 33 on the other part. The embodiment shown has the protrusion part 19 of body 3 extends at an angle β, to rigid part 20, of less than 180° (typically but not necessarily greater than 90°). The channel is arranged with its opening angle similarly.

Figure 4:
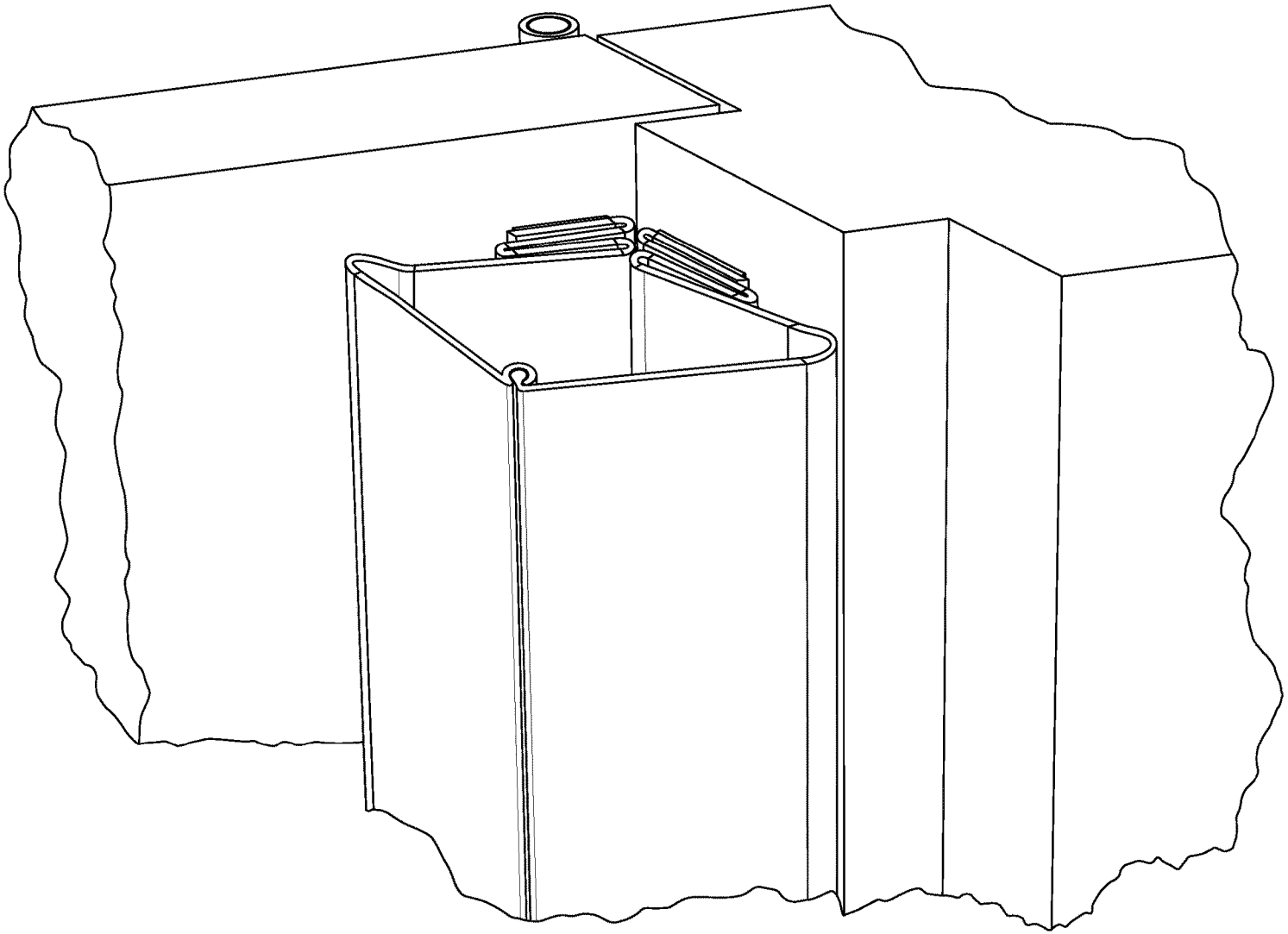
FIG. 4 shows the device with the door substantially closed.
Figure 5:
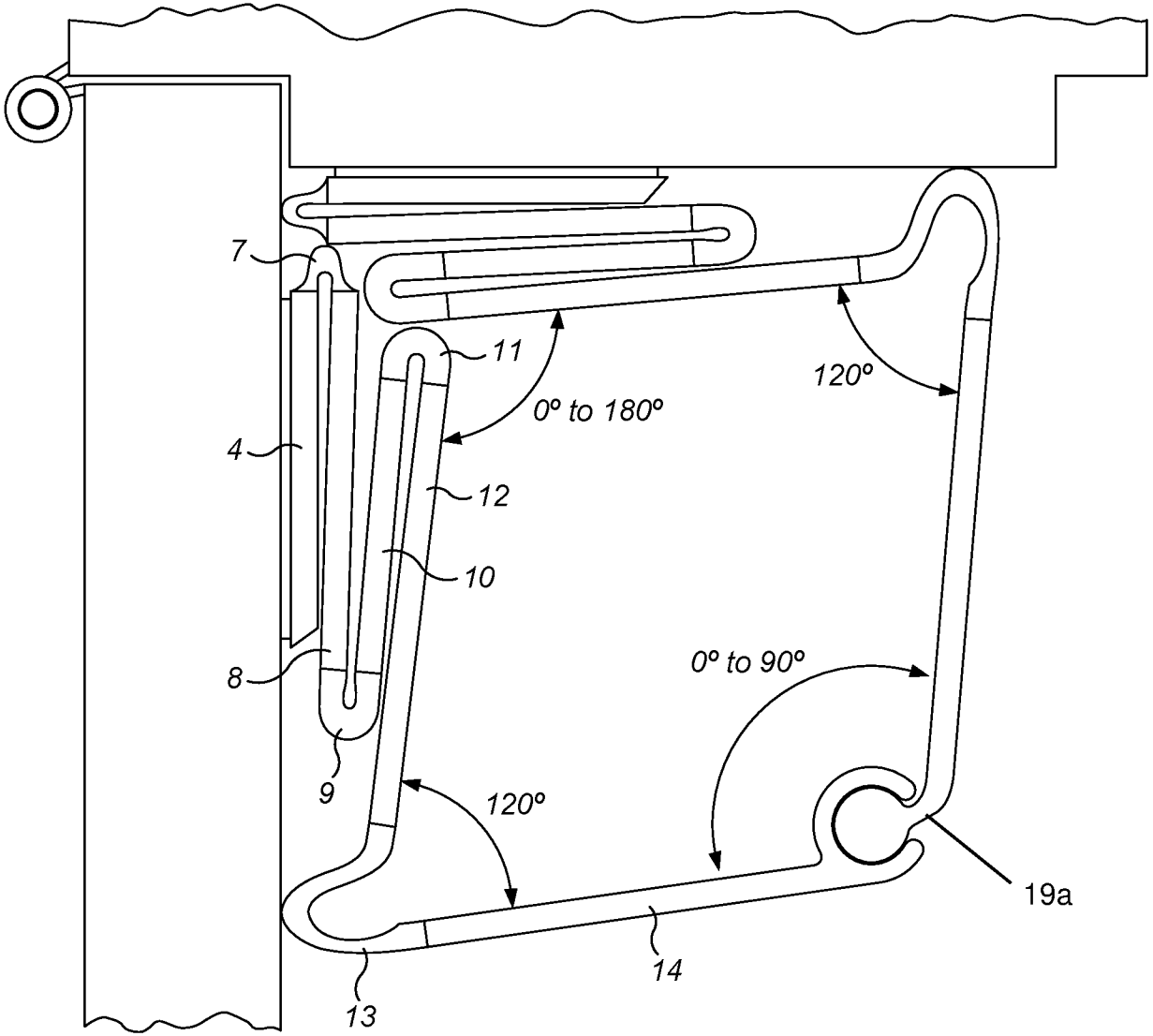
FIG. 5 shows a top view of the device with the door closed.

FIGS. 4 and 5 show the situation when the door is fully closed. For each body the parts are folded in the same way. Referring to body 2, the parts are folded upon each other such that, by virtue of hinges 7, 9 and 11, panels 4, 8, 10 and 12 lie substantially against each other flexed together by the hinges.

The zone defined by flexible panel 13 (see FIG. 1) and the body is therefore hinged by around 90° (i.e. a 120° angle around hinge formed by zone at this point.

As is shown in the Figures, at all dispositions, a child's fingers are prevented from entering the space between a door and frame and being possibly trapped.

FIGS. 6 to 11 show a further embodiment in which, instead of one of the bodies having a female connector (channel) and the other having a male connector (protrusion), both bodies 60, 70 have a female connector in the form of a channel 40, 41. Thus, both bodies are exactly the same in this embodiment which therefore has the advantage that both bodies are the same and therefore can be made from the same extrusion, cut into sections, for example.

In this embodiment, a separate connecting member (connection member 42 having a first edge 44*a* with a first edge connector 44*b* and a second edge 45*a* with a second edge connector 45*b*) is provided. This might of a more flexible plastic than the plastic used for the rigid panels, such as panel 12, or an equally rigid plastic and this includes a flat central elongate panel 43 and two lateral protrusions 44, 45. Each of these extend at an angle of 180° to the angle of the planar part and include a protrusion in the form of a bulbous cross-section part 46, 47 of greater width than at least the part of the flat panel 43 adjacent to them and which is adapted to locate within a corresponding one of channels 40 and 41.

In use, the joining part 42 can be inserted between bodies 2 and 3 either from the top or bottom when located within the slots, or by a push snap-fit (where the openings are flexible and formable) as desired. This therefore provides for the relative movement both rotationally and an elongate movement between the two bodies similar to that of the embodiment of FIGS. 1 to 5.

Alternatively both bodies may have a male connector (protrusion) and the joining member has two female connectors, or the joining member may have one male and one female edge and the bodies be the same bodes 2 and 3 for example.

Figure 7:
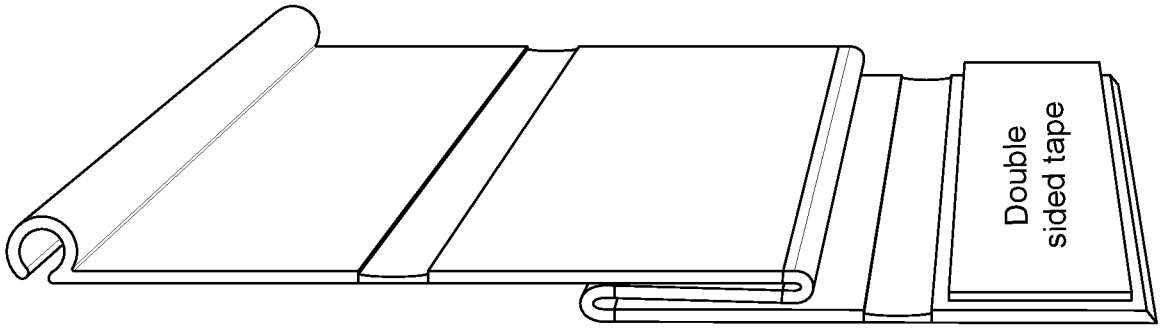
FIG. 7 shows one of the bodies in a folded position.
Figure 8:
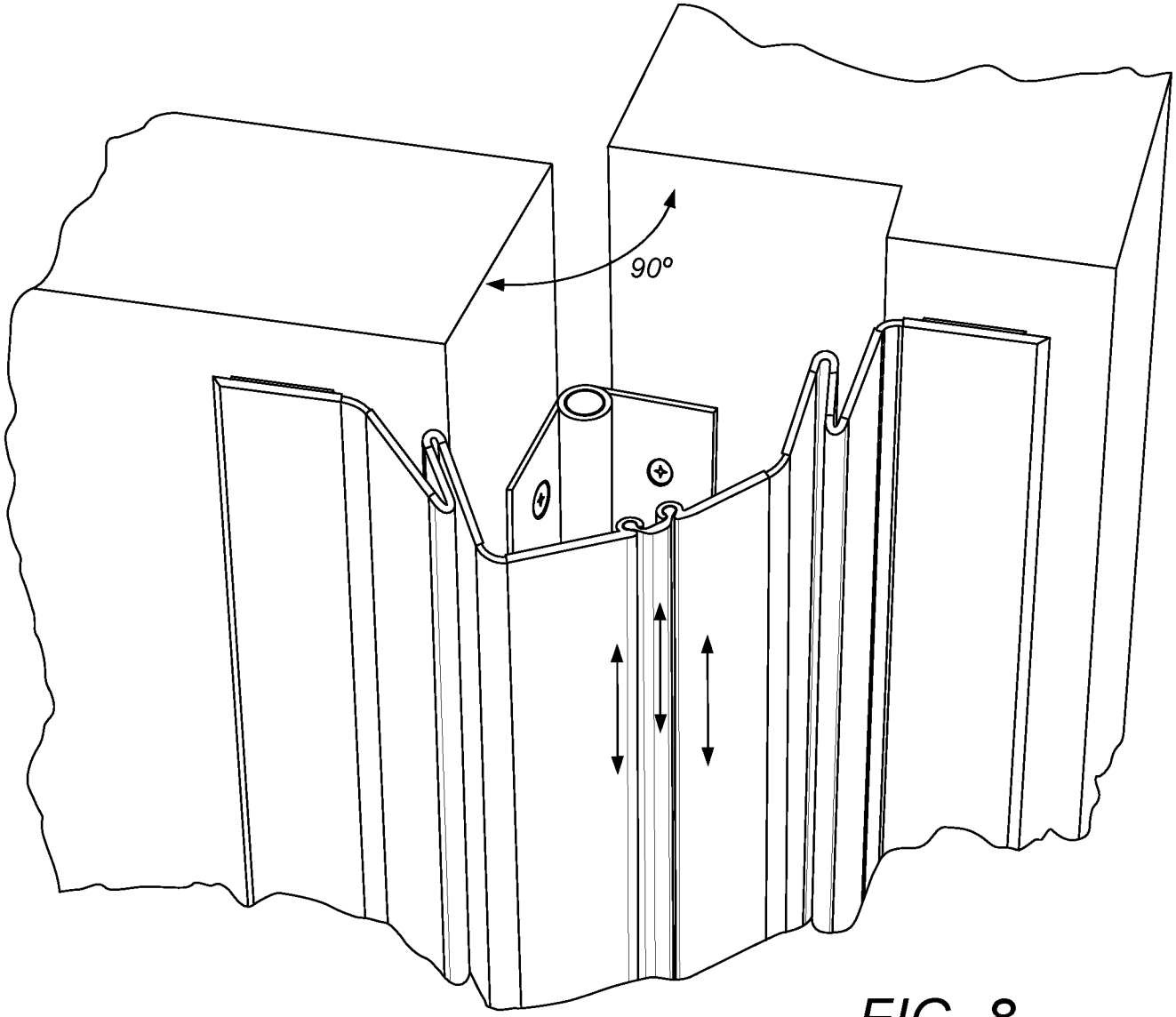
FIG. 8 shows the cover of FIG. 7 with the door partly open.
Figure 9:
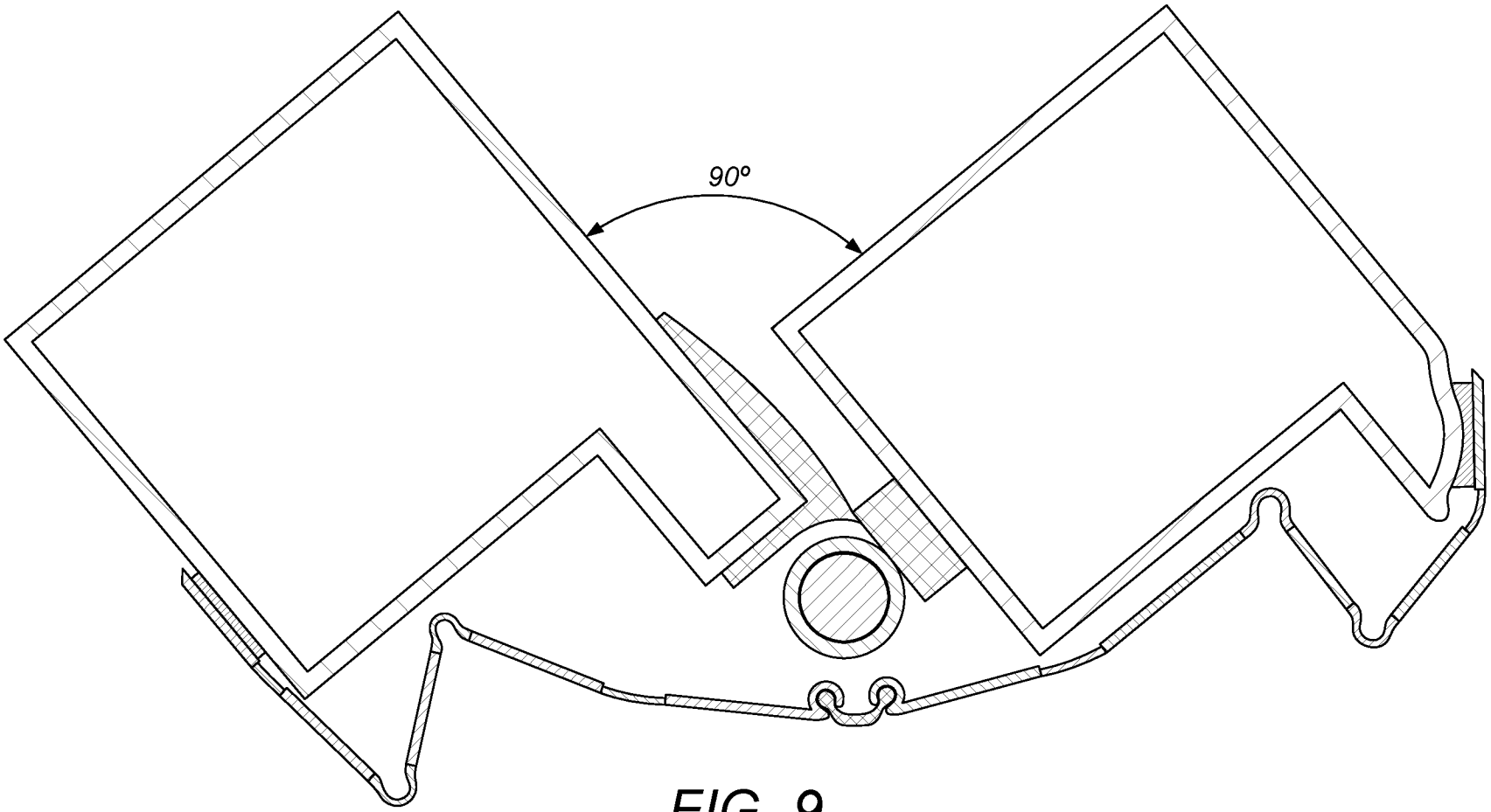
FIG. 9 shows the cover of FIG. 6 with the door further open.
Figure 10:
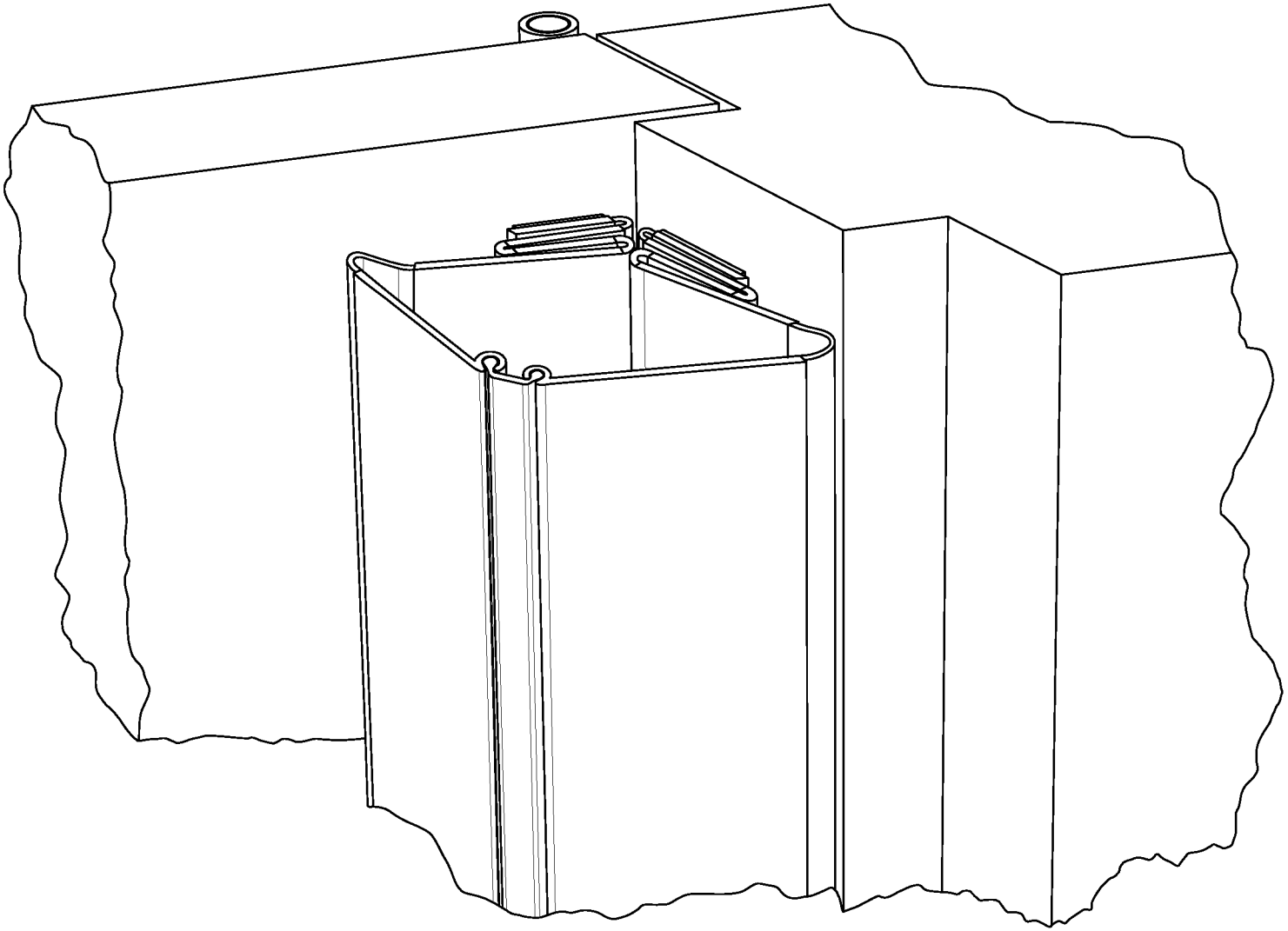
FIG. 10 shows the cover of FIG. 6 with the door substantially closed.
Figure 11:
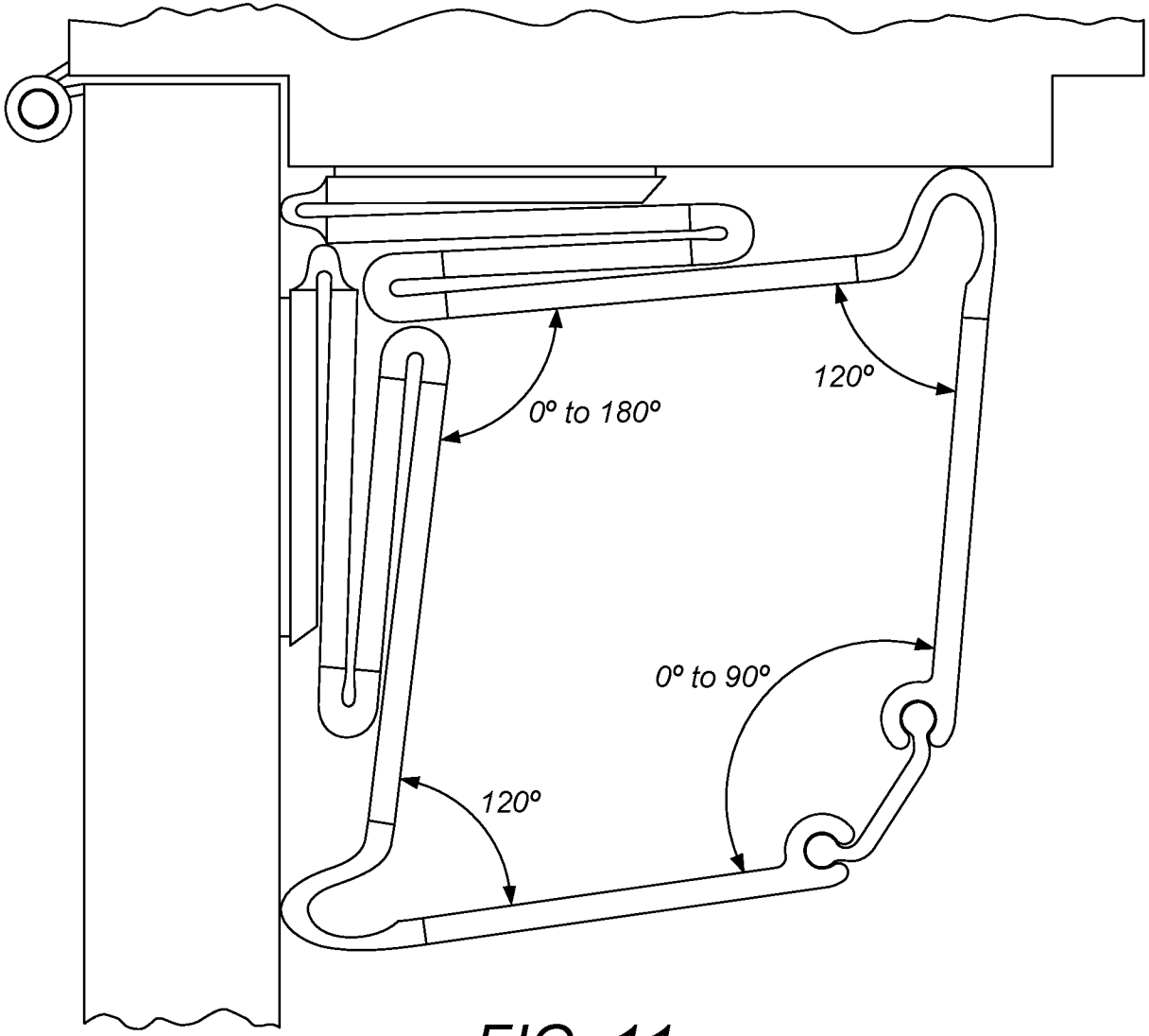
FIG. 11 shows the door of FIG. 6 from a top view with a cover attached.

FIG. 7 shows one of the bodies with some of the parts flattened against others.

Figure 6:
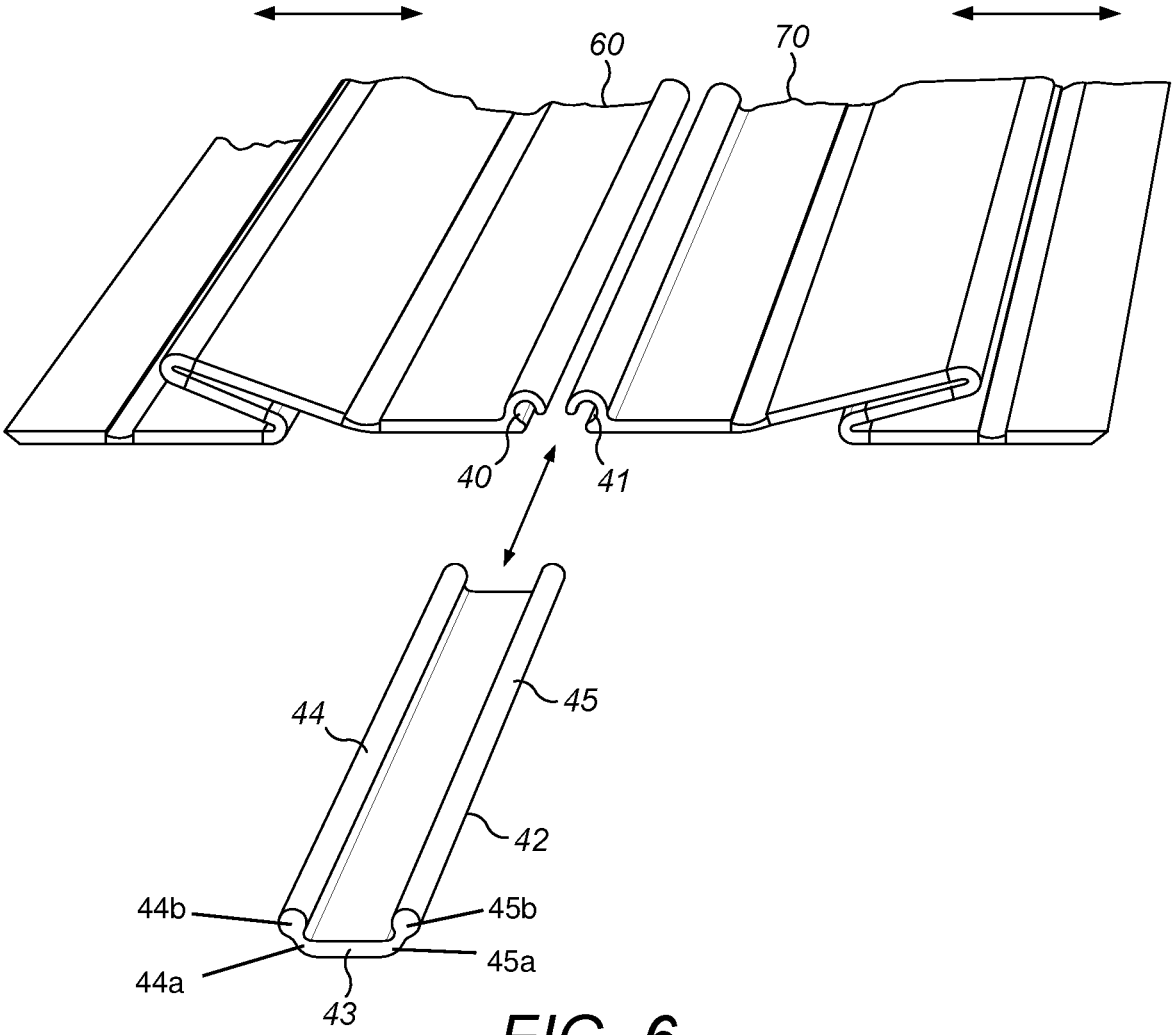
FIG. 6 shows an alternative door cover.

FIGS. 8 to 11 are equivalent to FIGS. 2 to 5 showing the embodiment of FIG. 6 in use. As shown, the two parts may move relative to each other in an elongate (vertical) direction to allow for rising butt hinges or other circumstances.

The combination of panels and hinges 4 to 14 of each body enables the effective length of each body to vary to increase as the door is opened and decrease as the door is closed to therefore enable a wide variety of door openings and sizes to be accommodated.

Other configurations which use two bodies hingably joined may be envisaged within the scope of the invention.

Figure 12:
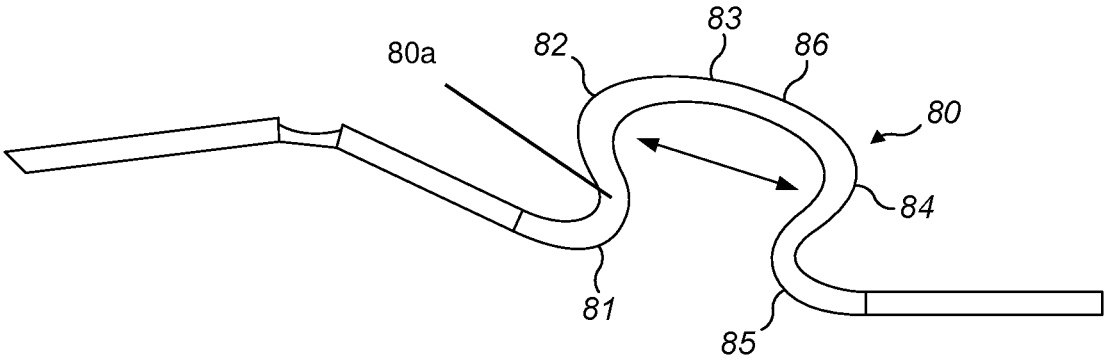
FIGS. 12 and 13 show alternative embodiments.

FIG. 12 is an alternative embodiment in which in at least one of the bodies, instead of separate hinges 9, 11 and 13 and panels 8 to 10 and 12, there is provided a single flexible panel 80*a* which is formed in a generally U shape as shown. This includes a first hinged section 80 which subtends an angle of greater than 270°, a second section 82 with an external angle of more than 90°, a curved rear face 83 and some hinge parts 84, 85 to 81 and 82 respectively. Thus, this in effect forms a U shape having a bulge at it closed end and a narrower waist part.

This part can therefore expand as a door is opened or can compress upon itself with hinges 81 and 82 towards each other. As the door is closed it can also fold upon each other upon itself.

Figure 13:
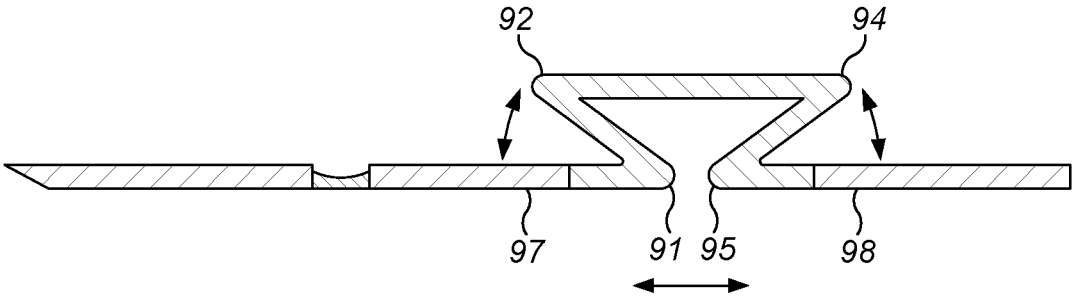

FIG. 13 shows another embodiment, similar to that of FIG. 12, in which instead a curved hinge part the hinges are formed by planar and angled hinges parts having a defined "memory" angle 91, 92, 95, 94. Clearly this will work in the same manner as the embodiment of FIG. 12 and many other embodiments, including ones which are generally very triangular cross-section for the flexible part highlighted in FIGS. 12 and 13 (i.e. parts 81 to 86) or other configurations. The parts may hinge towards or away from each other.

The hinge part shown may change shape in order for the guard to reach the closing frame for different types of door. The hinge parts will essentially move in the direction of the arrow, i.e. closing parts 91 and 95 towards each other and causing hinges 92 and 94 to move "downwardly" to close parts 97 and 98.

Figure 14:
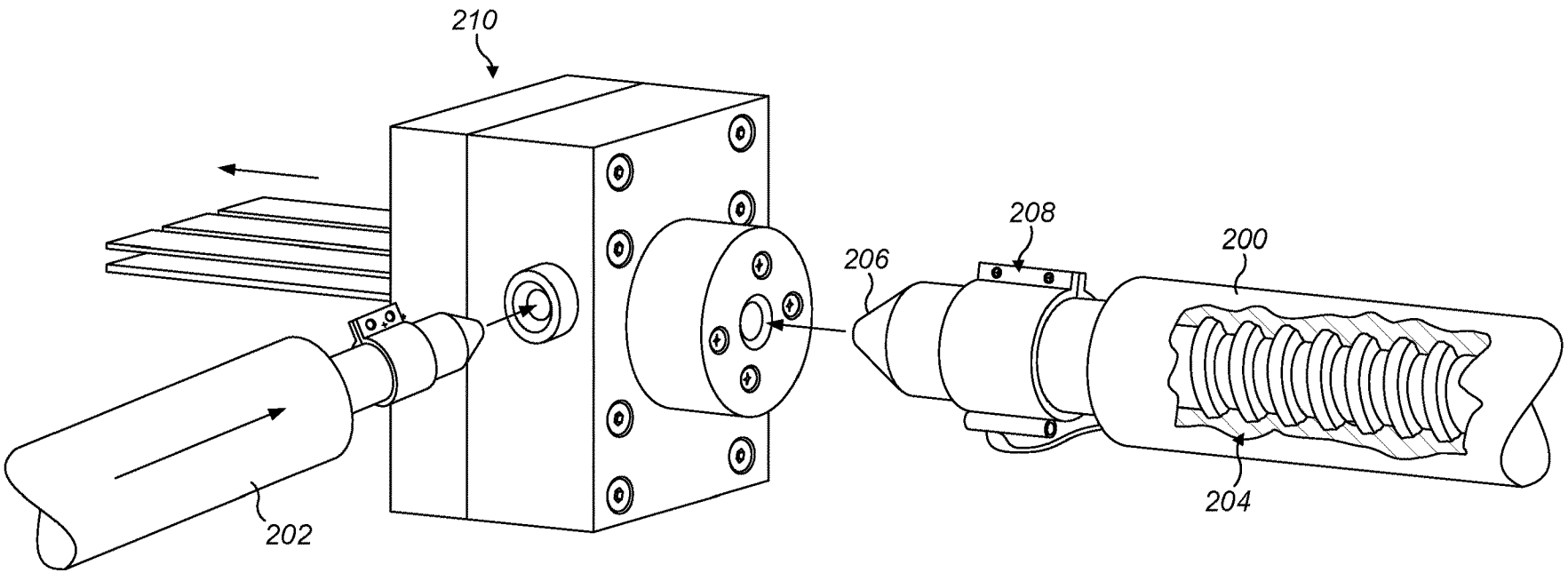
FIGS. 14 and 15 show a co-extrusion technology.
Figure 15:
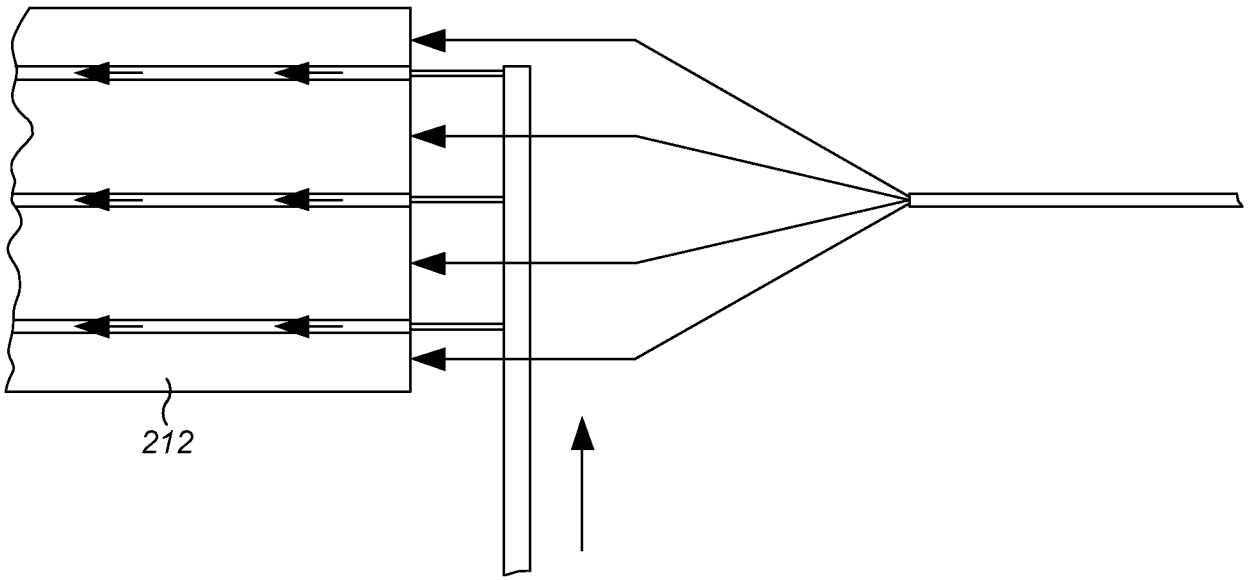

FIGS. 14 and 15 show, very schematically, a co-extrusion technique. Co-extrusion techniques are well known in themselves. Any convenient method may be used. The more rigid plastic material (e.g. UPVC) is applied to a first nozzle 200 and the second plastic material (also UPVC for example) is applied to a second nozzle 202. Each nozzle includes a screw 204 (not shown in nozzle 202) which drives the plastic to the outlet 206. The plastic is heated to a molten state by heaters 208 at each nozzle.

The outputs are applied to an extrusion die 210. In the embodiments shown the outputs are applied at 90° to each other. As shown in FIG. 15 the die is shaped to extrude ('co-extrude') both plastic materials simultaneously to obtain the profile (shown schematically only) 212.

I claim:

1. A cover device for an angle formed between an edge of a hinged door and a doorframe, comprising:

a first elongate body having a first proximal side and a first distal side opposite said first proximal side and being comprised of a plurality of first elongate panels being parallel to each other and a plurality of first hinge portions being between adjacent first elongate panels of said plurality of first elongate panels, wherein said plurality of first elongate panels is comprised of a first outer panel at said first proximal side so as to be attached to the door, wherein said plurality of first hinge portions is comprised of a first outer panel flexible hinge portion connected to said first outer panel opposite said first proximal side, wherein said plurality of first elongate panels is comprised of a first penultimate proximal panel connected to said first outer panel flexible hinge portion, said first outer panel being in a hinged relationship to said first penultimate proximal panel, wherein said plurality of first hinge portions is comprised of a first penultimate proximal hinge portion connected to said first penultimate proximal panel, wherein said plurality of first elongate panels is comprised of a first penultimate distal panel in a hinged relationship to said first penultimate proximal panel, wherein said plurality of first hinge portions is comprised of a first penultimate distal hinge portion connected to said first penultimate distal panel opposite said first penultimate proximal panel, and wherein said plurality of first elongate panels is comprised of a first inner panel connected to said first penultimate distal hinge portion, said first inner panel having a first inner panel distal end at said first distal side, said first inner panel being comprised of a first inner panel hinge connector at said first inner panel distal end; and a second elongate body;

having a second proximal side and a second distal side opposite said second proximal side and being comprised of a plurality of second elongate panels being parallel to each other and a plurality of second hinge portions being between adjacent second elongate panels of said plurality of second elongate panels, wherein said plurality of second elongate panels is comprised of a second outer panel at said second proximal side so at to be attached to the doorframe, wherein said plurality of second elongate panels is comprised of a second inner panel having a second inner panel distal end at said second distal side and being comprised of a second inner panel hinge connector at said second inner panel distal end and being removably hingedly attached to said first inner panel hinge connector along said first distal side, wherein a closed configuration of said first outer panel and said first inner panel corresponds to said first penultimate proximal panel and being in a concertina relationship between said first outer panel and said first penultimate distal panel, and wherein an opened configuration of said first outer panel and said first inner panel corresponds to said first inner panel having a degree of relative movement in a longitudinal direction parallel to said second inner panel.

2. The cover device as in claim 1, wherein said first inner panel hinge connector is a female connector, said female connector being comprised of a channel with an opening, and wherein said second inner panel hinge connector is a male connector, said male connector being comprised of a protrusion, said protrusion being removable engaged within said channel through said opening.

3. The cover device as in claim 2, wherein said male connector is further comprised of a waist portion between said protrusion and an opposite end of said second inner panel, said waist portion being narrower than said opposite end of said second inner pane.

4. The cover device as in claim 1, further comprising:

a connection member having a first edge with a first edge connector in removable hinged connection with said first distal side of said first elongate body and a second edge with a second edge connector in removable hinged connection with said second distal side of said second elongate body.

5. The cover device as in claim 4, wherein said first inner panel hinge connector is a female connector, wherein said first edge connector is a male connector removably in hinged engagement with said first inner panel hinge connector, wherein said second inner panel hinge connector is a female connector, and wherein said second edge connector is a male connector removably in hinged engagement with said second inner panel hinge connector.

6. The cover device, as in claim 4, wherein said first inner panel hinge connector is a male connector, wherein said first edge connector is a female connector removably in hinged engagement with said first inner panel hinge connector, wherein said second inner panel hinge connector is a male connector, and wherein said second edge connector is a female connector removably in hinged engagement with said second inner panel hinge connector.

7. The cover device, as in claim 4, wherein said first inner panel hinge connector is a male connector, wherein said first edge connector is a female connector removably in hinged engagement with said first inner panel hinge connector, wherein said second inner panel hinge connector is a female connector, and wherein said second edge connector is a male connector removably in hinged engagement with said second inner panel hinge connector.

8. The cover device, as in claim 4, wherein said first inner panel hinge connector is a female connector, wherein said first edge connector is a male connector removably in hinged engagement with said first inner panel hinge connector, wherein said second inner panel hinge connector is a male connector, and wherein said second edge connector is a female connector removably in hinged engagement with said second inner panel hinge connector.

9. The cover device as in claim 1, wherein said first elongate body is comprised of two different plastics having different rigidities.

10. The cover device as in claim 1, wherein said plurality of second hinge portions is comprised of a second penultimate distal hinge portion connected to said second inner panel, and wherein said first outer panel and said first penultimate distal panel form a first collapsible zone in said closed configuration, said first outer panel and said first penultimate proximal panel being flat against each other.

11. The cover device as claimed in claim 10, wherein said first inner panel and said second inner panel form an arcuate part between said first penultimate distal hinge portion and said second penultimate distal hinge portion in said closed configuration.

12. The cover device as claimed in claim 10, wherein said plurality of first elongate panels is comprised of a first middle panel in a hinged relationship to said first penultimate proximal hinge portion, and wherein said plurality of first hinge portions is comprised of a first middle hinge portion connected to said first middle panel, said first middle panel being in a hinged relationship to said first penultimate distal panel.

13. An entry system, comprising:

a cover device as in claim 1;

a door; and a doorframe.

14. The cover device, as in claim 1, wherein said plurality of second hinge portions is comprised of a second outer panel flexible hinge portion connected to said second outer panel opposite said second proximal side, wherein said plurality of second elongate panels is comprised of a second penultimate proximal panel connected to said second outer panel flexible hinge portion, said second outer panel being in a hinged relationship to said second penultimate proximal panel, wherein said plurality of second hinge portions is comprised of a second penultimate proximal hinge portion connected to said second penultimate proximal panel, wherein said plurality of second elongate panels is comprised of a second penultimate distal panel in a hinged relationship to said second penultimate distal panel, wherein said plurality of second hinge portions is comprised of a second penultimate distal hinge portion connected to said second penultimate distal panel opposite said second penultimate proximal panel, and wherein said second inner panel is connected to said second penultimate distal hinge portion.

15. The cover device, as in claim 1, wherein said second inner panel hinge connector is a female connector, said female connector being comprised of a channel with an opening, and wherein said first inner panel hinge connector is a male connector, said male connector being a protrusion, said protrusion being removable engaged within said channel through said opening.

16. The cover device, as in claim 1, wherein said plurality of first elongate panels is comprised of a first middle panel in a hinged relationship to said first penultimate proximal hinge portion, and wherein said plurality of first hinge portions is comprised of a first middle hinge portion connected to said first middle panel, said first middle panel being in a hinged relationship to said first penultimate distal panel.

* * * * *